US006851272B2

(12) United States Patent
Yu

(10) Patent No.: US 6,851,272 B2
(45) Date of Patent: Feb. 8, 2005

(54) APPARATUS FOR MAINTAINING FRESHNESS

(76) Inventor: Young-Sil Yu, 108-1503, Dogok Samsung Remian Apt. Dogok 2-Dong, Kangnam-Ku, Seoul (KR)

( * ) Notice: Subject to any disclaimer, the term of this patent is extended or adjusted under 35 U.S.C. 154(b) by 11 days.

(21) Appl. No.: 10/644,092

(22) Filed: Dec. 30, 2003

(65) Prior Publication Data

US 2004/0099003 A1 May 27, 2004

(30) Foreign Application Priority Data

| | | |
|---|---|---|
| Aug. 21, 2002 | (KR) | 10-2002-0049496 |
| Aug. 21, 2002 | (KR) | 10-2002-0049497 |
| May 10, 2003 | (KR) | 10-2003-0029633 |
| May 10, 2003 | (KR) | 10-2003-0029635 |

(51) Int. Cl.[7] ..... F25D 23/12
(52) U.S. Cl. ..... 62/310; 62/337
(58) Field of Search ..... 62/310–311, 337–339

(56) References Cited

U.S. PATENT DOCUMENTS

| | | | | |
|---|---|---|---|---|
| 4,830,223 A | * | 5/1989 | Priest | 222/146.6 |
| 5,188,169 A | * | 2/1993 | Lim | 165/225 |
| 5,911,745 A | * | 6/1999 | Conner | 62/91 |

* cited by examiner

*Primary Examiner*—William E. Tapolcai

(57) ABSTRACT

The aspect of this invention is to provide a freshness maintaining apparatus designed to keep various items fresh for a lengthy period of time. The apparatus includes a water storage unit (10). A support unit (11) is installed in the water storage unit (10), and cooling water is contained in the water storage unit under the support unit. A filtering unit (30) is connected to the water storage unit (10) via a drain line (20) to remove impurities from water flowing to the filtering unit. A cooling unit (40) is connected to an end of a water supply branching pipe (32) of the filtering unit (30) to cool the filtered water fed from the filtering unit to a predetermined temperature. A humidifying unit (50) is connected to another end of the water supply branching pipe (32) to atomize the filtered water fed from the filtering unit (30).

14 Claims, 17 Drawing Sheets

APPARATUS FOR MAINTAINING FRESHNESS

BACKGROUND OF THE INVENTION

1. Field of the Invention

The present invention relates, in general, to an apparatus for maintaining freshness and, more particularly, to an apparatus for storing items, including decoration flowers, perishable foodstuffs such as bean-curd, and fruit such as peaches, for a lengthy period of time and in large quantities while maintaining freshness of the items for a lengthy period of time by continuously supplying cool and humid air to the items.

2. Description of the Prior Art

As well known to those skilled in the art, a conventional freshness maintaining apparatus is designed such that compressed air is produced by an air compressor and is blown on items through a nozzle together with water, thus maintaining the freshness of the items.

However, the conventional apparatus has a problem in that water and compressed air are directly sprayed on the items stored in the apparatus through the nozzle, thus noise is generated due to the spray of the compressed air, and a temperature around the air compressor undesirably rises due to heat generated by an operation of the air compressor.

The conventional apparatus has another problem in that it is designed to increase the humidity of an area using the compressed air and the nozzle, therefore it is possible to increase the humidity of a limited area, that is, a narrow area, but it is difficult to increase the humidity of a large area to maintain the freshness of a large quantity of items. Further, the conventional apparatus has a further problem in that it is designed to atomize water and spray the atomized water to items by compressed air, so water which is not atomized may be discharged to the items, thus being in direct contact with the items. Particularly, when water is in direct contact with items, such as fruit and flowers, the items are rapidly spoiled, thus deteriorating value.

When an injection pressure is increased to overcome the above-mentioned problem, it is possible to increase the humidity of a large storage space, but noise is generated and operational safety of the apparatus is poor, thus exerting a bad influence on items stored in the storage space. Further, although the storage space is humid, parts of the items are dried due to the compressed air. In order to solve such a problem, a plurality of injection nozzles may be installed in the storage space. However, in this case, installation costs as well as equipment costs are increased, thus it is economically inefficient.

Further, in order to overcome the above-mentioned problems, there is proposed another conventional apparatus which is provided with a refrigerant circulation unit to increase the humidity of a storage space without using compressed air. However, the conventional apparatus has a problem in that it is small in size, thus it is possible to freshly store a small quantity of items, but it is impossible to store a large quantity of items. The conventional apparatus has another problem in that it is impossible to store a large quantity of items, due to characteristics of the refrigerant circulation unit integrated with the apparatus. In addition to these problems, the conventional apparatus has several problems.

SUMMARY OF THE INVENTION

Accordingly, the present invention has been made keeping in mind the above problems occurring in the prior art, and an aspect of the present invention is to provide an apparatus for maintaining freshness of items, including foodstuffs such as bean-curd, vegetables and fruit, and flowers, for a lengthy period of time.

Another aspect of the present invention is to provide an apparatus for maintaining freshness, which supplies atomized water of 2~6° C. to items stored in the apparatus, thus allowing the items to keep an optimum condition.

A further aspect of the present invention is to provide an apparatus for maintaining freshness, which allows items to be kept fresh for a lengthy period of time when the items have to be moved to a distant place.

Still another aspect of the present invention is to provide an apparatus for maintaining freshness, which is designed to have a small size in addition to keeping items fresh for a lengthy period of time, thus being convenient to carry.

In order to accomplish the above aspect, the present invention provides an apparatus for maintaining freshness, including a water storage unit, with a support unit being installed in the water storage unit and cooling water being contained in the water storage unit under the support unit, a filtering unit connected to the water storage unit via a drain line and functioning to remove impurities from water flowing to the filtering unit, a cooling unit connected to a first end of a water supply branching pipe of the filtering unit so that a part of filtered water is supplied to the cooling unit and functioning to cool the filtered water fed from the filtering unit to a predetermined temperature prior to feeding the cool water to the water storage unit, and a humidifying unit connected to a second end of the water supply branching pipe of the filtering unit and functioning to atomize another part of the filtered water fed from the filtering unit prior to feeding the atomized water to the water storage unit, thus allowing cooling water and cool and humid air to be continuously fed to items stored in the apparatus.

BRIEF DESCRIPTION OF THE DRAWINGS

The above and other aspects, features and other advantages of the present invention will be more clearly understood from the following detailed description taken in conjunction with the accompanying drawings, in which.

DESCRIPTION OF THE PREFERRED EMBODIMENTS

Figure 1:
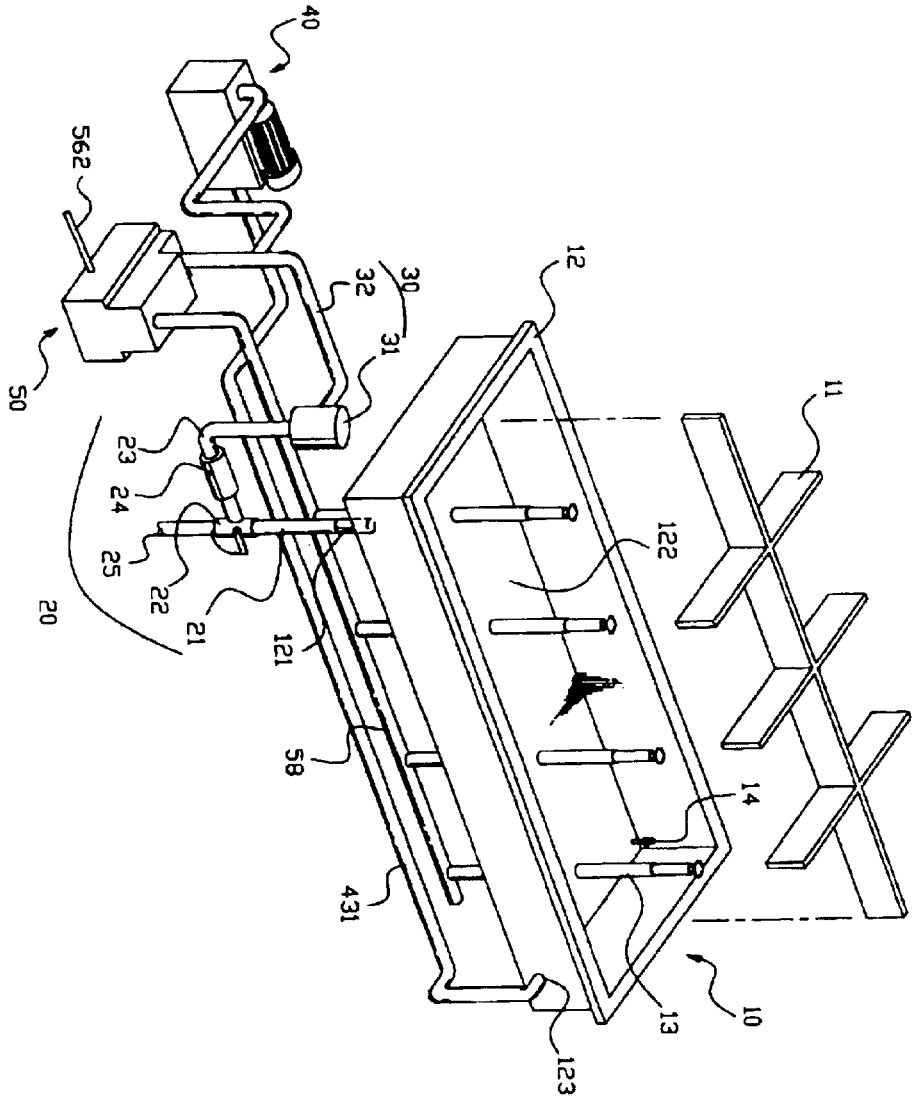
FIG. 1 is a perspective view showing a freshness maintaining apparatus, according to a first embodiment of the present invention.

Reference should now be made to the drawings, in which the same reference numerals are used throughout the different drawings to designate the same or similar components.

A freshness maintaining apparatus according to the present invention is designed to continuously supply cool and humid air of 2~6° C. to items stored in a sealed space or a storage space. That is, the apparatus is operated to atomize low-temperature water prior to feeding the atomized water to the items. Thus, although atomized humid air is in contact with the items, the items are not wholly moistened on their surfaces. As such, the apparatus of the present invention stores the items while maintaining the freshness thereof using atomized, cool, and humid air.

Figure 5:
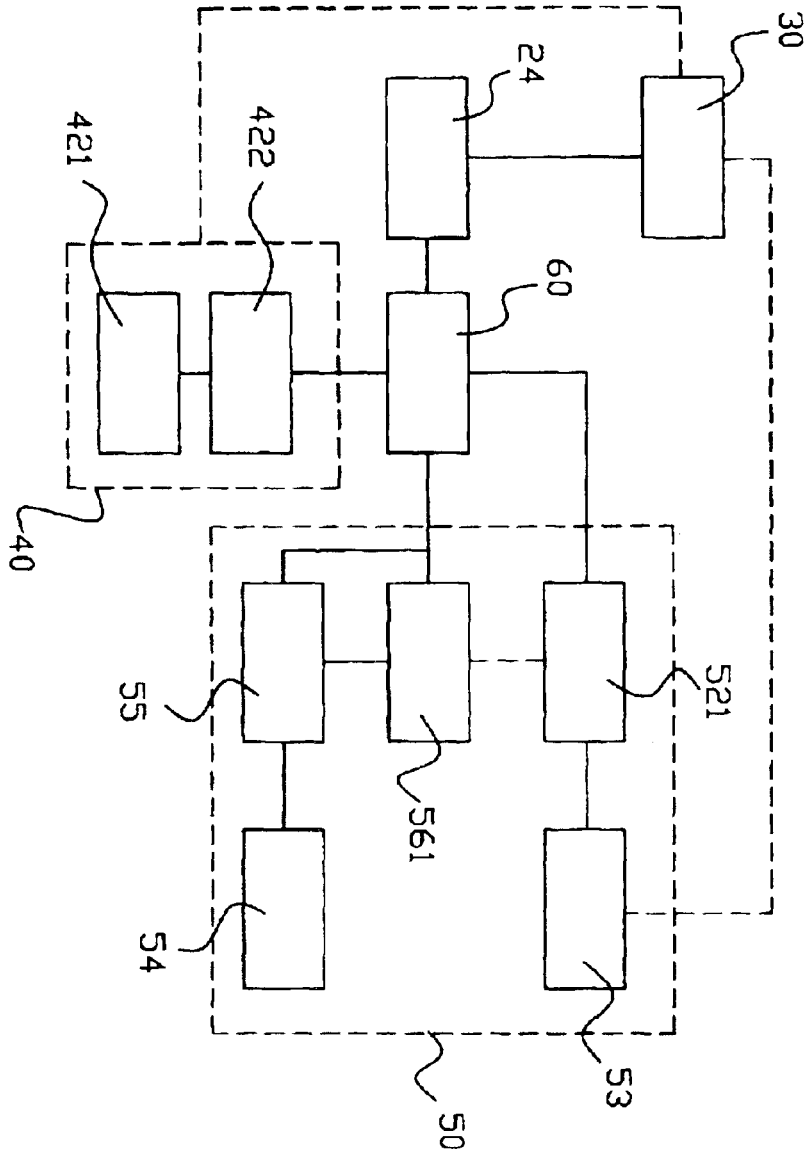
FIG. 5 is a block diagram showing the connection structure of several units included in the apparatus of FIG. 1.

FIG. 1 is a perspective view showing a freshness maintaining apparatus, according to a first embodiment of the present invention. FIG. 5 is a block diagram showing the connection structure of several units included in the apparatus of FIG. 1. According to the first embodiment of the present invention, the apparatus includes a water storage unit 10, a drain line 20, a filtering unit 30, a cooling unit 40, and a humidifying unit 50. The water storage unit 10 contains water therein. A support unit 11 is positioned above the surface of water contained in the water storage unit 10 to support items stored in the water storage unit 10. The water circulates from the water storage unit 10 through the drain line 20 and the filtering unit 30 to the cooling unit 40, and is cooled by the cooling unit 40. The cool water flows to a humidifying unit 50 through the drain line 20 and the filtering unit 30. After the cool water is atomized by the humidifying unit 50, the atomized water is supplied to the items supported by the support unit 11.

The water storage unit 10 includes a body 12 which stores the items therein and contains water therein. A drain hole 121 is provided at a predetermined position of a bottom 122 of the body 12 to be connected to the drain line 20, and a connection hole 123 is provided at a predetermined position of the body 12 to be connected to the cooling unit 40. The support unit 11 is integrally installed on the body 12 to be parallel to the bottom 122 of the body 12, and functions to support the stored items. A plurality of humidifying pipes 13 are mounted to the body 12 in such a way as to uprightly stand on the bottom 122 of the body 12. In this case, each of the humidifying pipes 13 vertically passes through the support unit 11 such that an upper end of each of the humidifying pipes 13 is positioned above the support unit 11. A water level sensor 14 is installed at a predetermined position of the bottom 122 of the body 12 to sense a water level.

The drain hole 121 and the connection hole 123 are provided on the body 12 of the water storage unit 10 in such a way that the drain hole 121 and the connection hole 123 are positioned at both ends of a sidewall of the body 12, respectively. The support unit 11 is integrally installed on an upper portion of the body 12 of the water storage unit 10, thus an upper portion of the water storage unit 10 is sectioned into a plurality of sections by the support unit 11 but a lower portion of the water storage unit 10 has a single section. That is, the water is stored in the water storage unit 10 to be positioned under the support unit 11. The water storage unit 10 may have various shapes, including a cylinder shape, a box shape, and a truncated shape.

The items may be seated on the support unit 11. Or, the items may be supported by a plurality of holes which are formed in the support unit 11. In order to support a load of the items, the support unit 11 may be fabricated in the form of woven wire, non-woven fabric, fabric, woven pulp, etc. Alternatively, the support unit 11 may be manufactured through a plastic injection molding. Further, the size of the holes formed in the support unit 11 may be varied, according to the size of the items. Furthermore, different support units combined with each other may be used to support two or more different items.

Figures 2A, 2B:
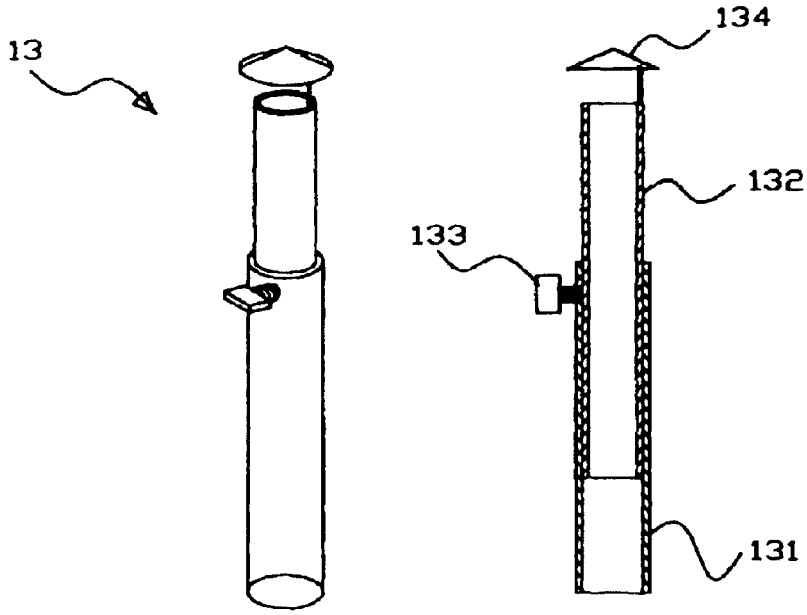
FIGS. 2A and 2B are views showing a humidifying pipe included in the apparatus of FIG. 1.

The humidifying pipes 13 function to feed humid air atomized by the humidifying unit 50 to the water storage unit 10. As shown in FIGS. 2A and 2B, each of the humidifying pipes 13 includes a lower pipe 131, an upper pipe 132, a locking member 133, and a spraying part 134. The lower pipe 131 is installed on the bottom 122 of the water storage unit 10 to be connected to the humidifying unit 50. The upper pipe 132 is inserted into the lower pipe 131. The locking member 133 is installed at a predetermined position of an upper portion of the lower pipe 131 to lock the upper pipe 132 to the lower pipe 131. The spraying part 134 is installed at the upper end of the upper pipe 132. In this case, each of the humidifying pipes 13 is mounted to the water storage unit 10 so that the upper end of the humidifying pipe 13 provided with the spraying part 134 is positioned above the support unit 11.

Further, the upper pipe 132 of each of the humidifying pipes 13 is inserted into the lower pipe 131 so that an outer surface of the upper pipe 132 is in close contact with an inner surface of the lower pipe 131. The upper pipe 132 is locked to the lower pipe 131 by the locking member 133 which is installed at the predetermined position of the lower pipe 131 in a screw fastening method. That is, the locking member 133 passes through the lower pipe 131, and comes into contact with the outer surface of the upper pipe 132 to lock the upper pipe 132 to the lower pipe 131.

The spraying part 134 has an umbrella shape. The humid air fed through the upper and lower pipes 131 and 132 contact the spraying part 134, and subsequently contact the upper portion of the water storage unit 10 in which the items are stored.

The shape of spraying the humid air is changed, according to positions of the humidifying pipes 13 which are mounted to the water storage unit 10 as well as the shape of the spraying part 134.

Further, a cover (not shown) made of a transparent material, such as acryl, glass, and plastics, may be mounted to an upper portion of the water storage unit 10. The cover may be mounted on the upper portion of the water storage unit 10 so that the cover is open at an upper portion thereof or closed at upper, lower, left, and right portions thereof. Further, a door may be mounted to a predetermined portion of the cover to allow the items to be easily placed into and taken out from the water storage unit 10.

The drain line 20 functions to discharge water from the water storage unit 10 to an outside and to feed water to the filtering unit 30. As shown in FIG. 1, the drain line 20 includes a first drain pipe 21, an automatic valve 22, a second drain pipe 23, a water supply pump 24, and a third drain pipe 25. The first drain pipe 21 is connected to the drain hole 121 of the water storage unit 10. The automatic valve 22 is connected to an end of the first drain pipe 21. The second drain pipe 23 is connected at a first end thereof to the automatic valve 22 and at a second end thereof to the filtering unit 30. The water supply pump 24 is installed at a predetermined position of the second drain pipe 23. The third drain pipe 25 is connected to the automatic valve 22 to discharge water to the outside. That is, the drain line 20 is designed to discharge water from the water storage unit 10 to the outside or to feed water to the filtering unit 30 by an operation of the automatic valve 22. The automatic valve 22 is designed to be automatically controlled by a control unit 60 or manually controlled by a user.

The filtering unit 30 functions to filter water contained in the water storage unit 10, prior to feeding the filtered water to the cooling unit 40 and the humidifying unit 50. The filtering unit 30 includes a filter 31 and a water supply branching pipe 32. In this case, the filter 31 is connected to the second drain pipe 23, and functions to remove impurities from water fed from the water storage unit 10. The water supply branching pipe 32 functions to feed the water from the filter 31 to the cooling unit 40 or the humidifying unit 50. First, the water is fed from the water storage unit 10 to the filter 31 by an operation of the water supply pump 24. Next, the filter 31 removes impurities from the water fed from the water storage unit 10. Thereafter, the filtered water is fed to the cooling unit 40 and the humidifying unit 50 through the water supply branching pipe 32. That is, the water supply branching pipe 32 has a 'Y' shape so that the water supply branching pipe 32 is connected at a first end thereof to the cooling unit 40, connected at a second end thereof to the humidifying unit 50, and connected at a third end thereof to the filter 31.

Figure 4:
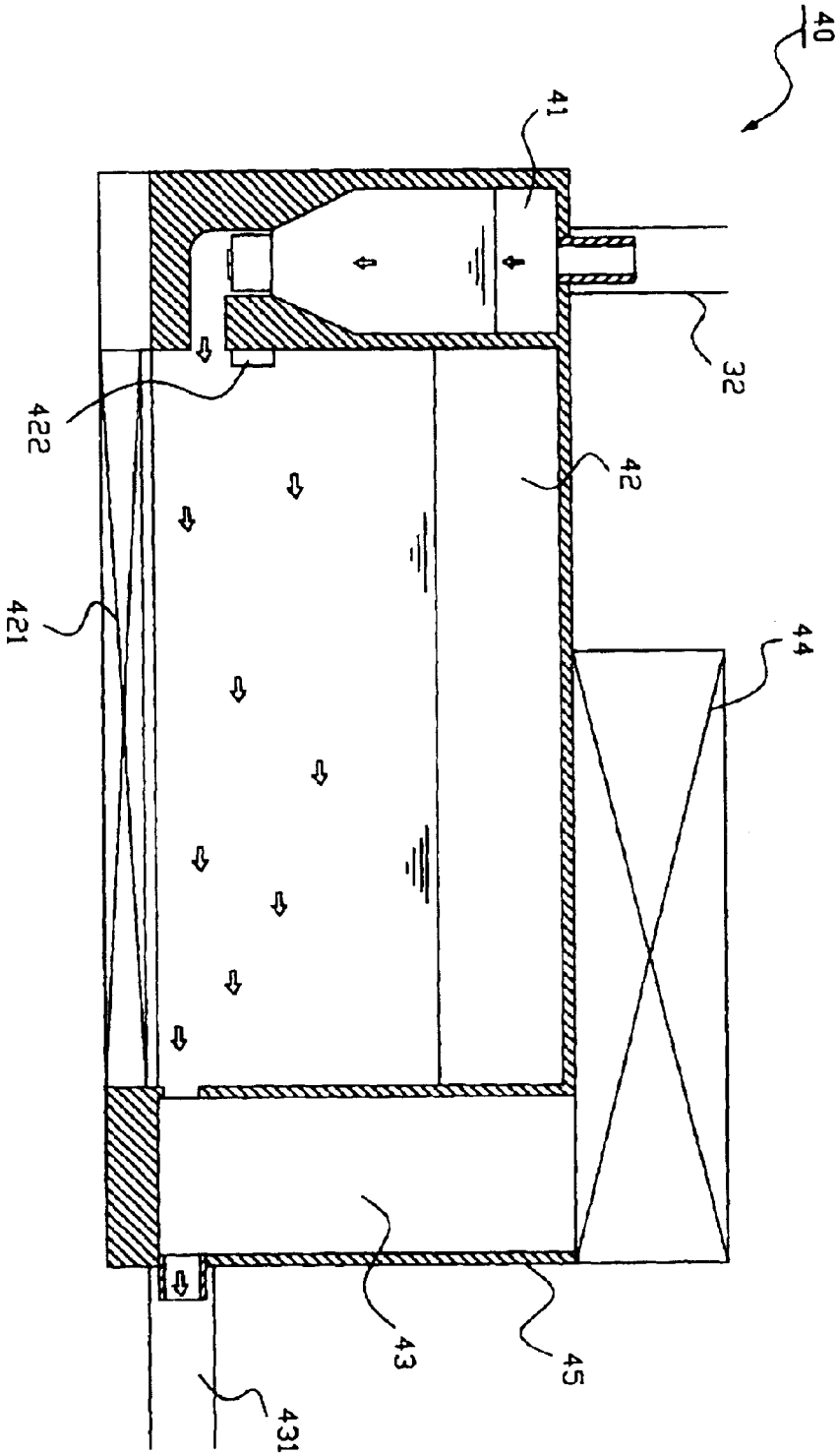
FIG. 4 is a sectional view of a cooling unit included in the apparatus of FIG. 1.

The cooling unit 40 functions to cool the water filtered by the filtering unit 30 to a predetermined temperature, prior to feeding the cool water back to the water storage unit 10 by an operation of a feed pump 44. As shown in FIG. 4, the cooling unit 40 includes a housing 45. A water inlet port 41, a cooling part 42, and a water feed unit 43 are integrally provided in the housing 45. The water passing through the water supply branching pipe 32 flows to the cooling unit 40 through the water inlet port 41. The cooling part 42 functions to cool the water supplied through the water inlet port 41 to the predetermined temperature by a cooling means 421 which is installed on a bottom of the cooling part 42. A water temperature sensor 422 is installed in the cooling part 42. The water feed unit 43 communicates with the cooling part 42, and functions to feed the cool water from the cooling unit 40 to the water storage unit 10 through a cool water supply pipe 431. The feed pump 44 is mounted on a top wall of the housing 45 to be connected to the water feed unit 43.

The water inlet port 41 is connected to the first end of the water supply branching pipe 32, and the water flowing from the filtering unit 30 is temporarily kept in the water inlet port 41.

The cooling part 42 functions to cool the water fed to the cooling unit 42 to the predetermined temperature. In order to cool the water fed to the cooling unit 42, the cooling means 421 is installed on the bottom of the housing 45. In this case, the cooling means may comprise a thermoelement which is in contact with the water to cool the water, a heat sink and a radiation fan which are installed under the thermoelement to dissipate heat generated by the thermoelement.

According to the embodiment of the present invention, the cooling means 421 may comprise a heat exchanger to cool the water flowing to the cooling part 42, in place of the thermoelement.

The water feed unit 43 communicates with the cooling part 42 and the feed pump 44. That is, as the feed pump 44 is operated, the water cooled by the cooling part 42 flows through the cool water supply pipe 431 to the water storage unit 10.

Further, a water temperature sensor 422 is installed at a position where the cooling part 42 communicates with the water feed unit 43, thus detecting a temperature of the water flowing to the water feed unit 43.

Figure 3:
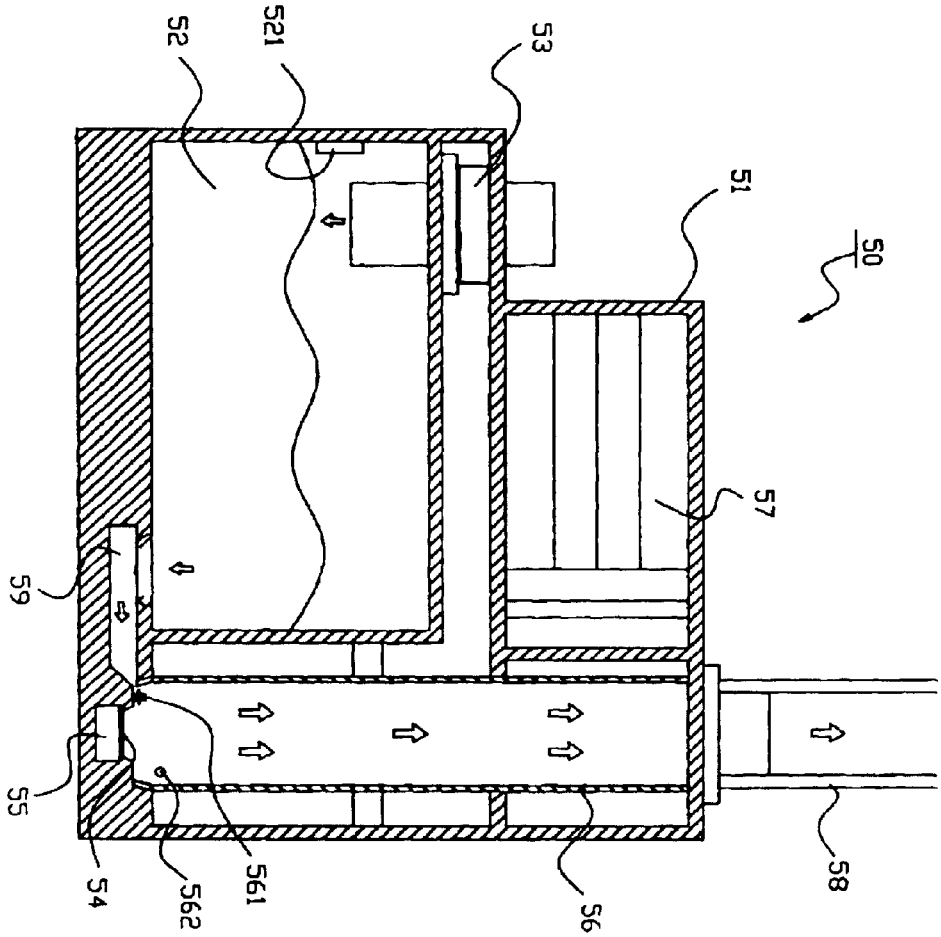
FIG. 3 is a sectional view of a humidifying unit included in the apparatus of FIG. 1.

The humidifying unit 50 functions to atomize the water fed from the filtering unit 30. As shown in FIG. 3, the humidifying unit 50 includes a body 52. The body 52 is provided in a housing 51 and connected to the second end of the water supply branching pipe 32 of the filtering unit 30 so that the filtered water from the filtering unit 30 is fed into and stored in the body 52. A water level sensor 521 is installed at a predetermined position in the body 52. An automatic shutoff valve 53 is installed between the body 52 and the housing 51 and actuated in response to a signal output from the water level sensor 521. A vibrator 54 is mounted to a predetermined position on a bottom of the housing 51, and functions to convert water fed from the body 52 into water vapor by vibration. A high-frequency wave generator 55 is mounted to a bottom of the vibrator 54 to actuate the vibrator 54. A humid air supply channel 56 upwardly and uprightly extends from the bottom of the housing 51 in such a way that the vibrator 54 is positioned at a lower end of the channel 56. A blower 57 is installed to communicate with the humid air supply channel 56. A distributing pipe 58 is connected at an end thereof to the humid air supply channel 56 and at predetermined portions thereof to a plurality of humidifying pipes 13 of the water storage unit 10.

The lower end of the humid air supply channel 56 to which the vibrator 54 is mounted is coupled to the body 52 by a coupling pipe 59. A water level sensor 561 is installed at the lower end of the humid air supply channel 56 connected to the coupling pipe 59, that is, a predetermined position of a lower portion of the channel 56 to which the vibrator 54 is mounted, thus detecting a level of the water fed to the lower portion of the channel 56.

The operation of the humidifying unit 50 constructed in this way is as follows. First, a level of water contained in the body 52 is detected by the water level sensor 521 installed in the body 52. The automatic shutoff valve 53 is actuated in response to a signal output from the water level sensor 521 to automatically feed water to the body 52. The water contained in the body 52 flows to the humid air supply channel 56 provided with the vibrator 54 through the coupling pipe 59. Further, the water fed to the humid air supply channel 56 is atomized by the vibrator 54 which is vibrated by the high-frequency wave generator 55, and then the atomized water is fed from the humid air supply channel 56 to the distributing pipe 58 which is connected to a plurality of humidifying pipes 13 of the water storage unit 10, by the blower 57.

Further, a water level regulating pipe 562 is provided at a predetermined position in the humid air supply channel 56 to discharge the water from the channel 56 to the outside. That is, when an amount of the water fed to the humid air supply channel 56 is too high to be atomized by the vibrator 54, the water level regulating pipe 562 functions to discharge the water to the outside. When the humidifying unit 50 is positioned on an inclined place, an excessive amount of water is fed to the humid air supply channel 56, thus a desired humidifying effect is not accomplished. In order to solve such a problem, the water level regulating pipe 562 is provided in the humid air supply channel 56. Further, a valve (not shown) is installed at a predetermined position of the water level regulating pipe 562.

FIG. 5 is a block diagram showing the connection structure of several units included in the apparatus, according to the first embodiment of the present invention. The operation of the apparatus according to the first embodiment of the present invention will be described in the following with reference to FIGS. 1 to 4.

When one desires to keep items, such as flowers, foodstuffs, fruit, and others, fresh using the apparatus according to the first embodiment of the present invention, the items are stored in the water storage unit 10 to be supported by the support unit 11. Next, in response to a signal output from the control unit 60, the water supply pump 24 and the thermoelement or heat exchanger of the cooling unit 40 are operated and the vibrator 54 is vibrated by the high-frequency wave generator 55. At this time, the water is fed from the water storage unit 10 to the filtering unit 30. After passing through the filtering unit 30, the water fed to the cooling unit 40 is cooled to the predetermined temperature of 2~4° C., and the water fed to the humidifying unit 50 is atomized by the vibrator 54. Thereafter, the water is returned to the water storage unit 10.

In a detailed description, the water is fed to the filtering unit 30 by the operation of the water supply pump 24, and subsequently the filtered water is fed through the water supply branching pipe 32 to the humidifying unit 50 and the cooling unit 40, respectively. The water fed to the cooling unit 40 is temporarily stored in the water inlet port 41, and then flows to the cooling part 42. The water flowing to the cooling part 42 is cooled to the predetermined temperature by the thermoelement. The cooled water is fed to the water feed unit 43, and then flows back to the water storage unit 10 through the cool water supply pipe 431 by the operation of the feed pump 44 which is connected to the water feed unit 43. Further, the water fed to the humidifying unit 50 is temporarily stored in the body 52, and then flows to the humid air supply channel 56 to which the vibrator 54 is mounted, through the coupling pipe 59. In the humid air supply channel 56, the water is atomized by the vibrator 54, and subsequently flows to the humidifying pipes 13 of the water storage unit 10 along the distributing pipe 58, by the blower 57.

In this case, the water level sensor 521 is installed in the humidifying unit 50, therefore the automatic shutoff valve 53 is automatically opened when the water contained in the body 52 is below a predetermined amount, thus feeding water through the water supply branching pipe 32 to the body 52.

By continuously circulating the cool water as such, the water contained in the water storage unit 10 and the humidifying unit 50 maintains the predetermined temperature. Further, by continuously supplying the humid air, the cool and humid air is supplied to the water storage unit 10.

Further, the water level sensor 14 is installed in the water storage unit 10 to determine whether a level of the water contained in the water storage unit 10 is below a predetermined level. When the water level is below the predetermined level, the control unit 60 is operated so that the apparatus sounds or an alarm lamp flashes to warn a person that the water supply is insufficient.

Figure 10:
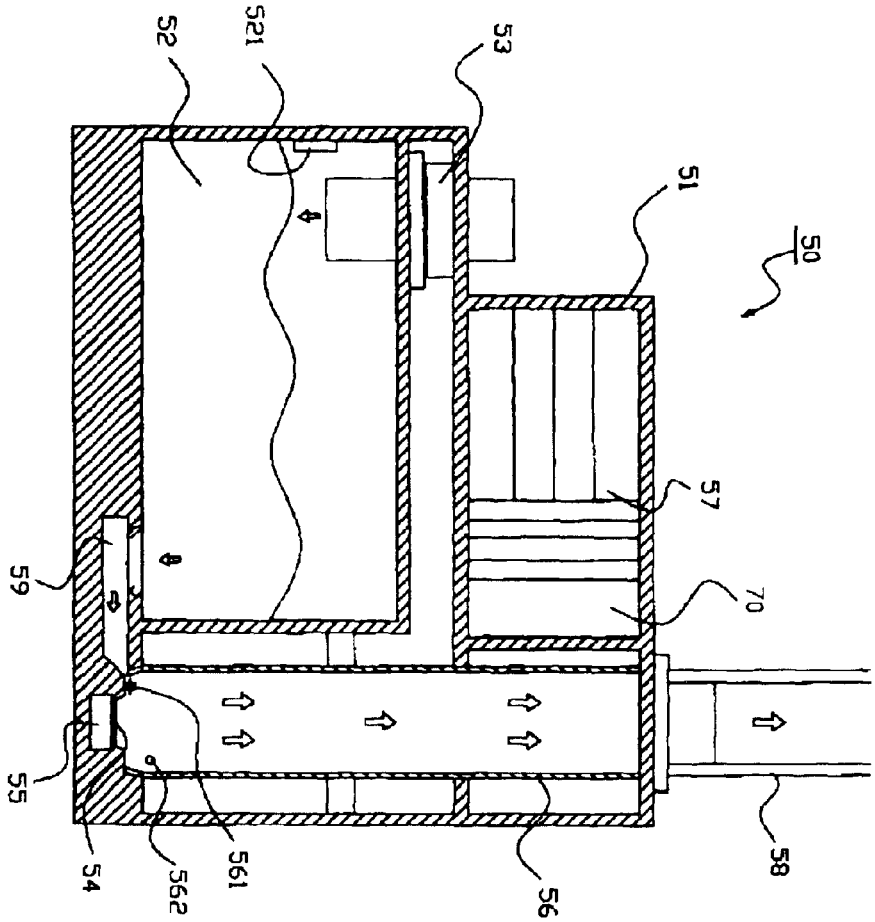
FIG. 10 is a sectional view showing a freshness maintaining apparatus, according to a fifth embodiment of the present invention, with a humidifying unit of the apparatus being provided with a dehumidifying unit.

Further, as shown in FIG. 10, a dehumidifying unit 70 may be provided in the humidifying unit 50 so that the humidifying unit 50 selectively executes a humidifying operation or dehumidifying operation. The dehumidifying unit 70 may use a thermoelement or a hot-wire coil. That is, when the high-frequency microwave generator 55 is stopped and the dehumidifying unit 70 is operated, air flowing to the humid air supply channel 56 by the blower 57 is cooled and dehumidified by the dehumidifying unit 70. The cool and dehumidified air is fed to the humidifying pipes 13 of the water storage unit 10 through the humid air supply channel 56 and the distributing pipe 58. The dehumidifying unit 70 is installed to be positioned between the blower 57 of the humidifying unit 50 and the humid air supply channel 56. That is, according to a selective operation of the high-frequency microwave generator 55 or the dehumidifying unit 70, cool/humidified air or cool/dried air is fed to the water storage unit 10. According to the present invention, when the dehumidifying unit 70 is installed in the humidifying unit 50 as such, the humidifying unit 50 is operated so that cool and humid air may be fed to the distributing pipe 58 by the high-frequency microwave generator 55 or cool and dry air may be fed to the distributing pipe 58 by the dehumidifying unit 70 according to environmental conditions.

Figure 17:
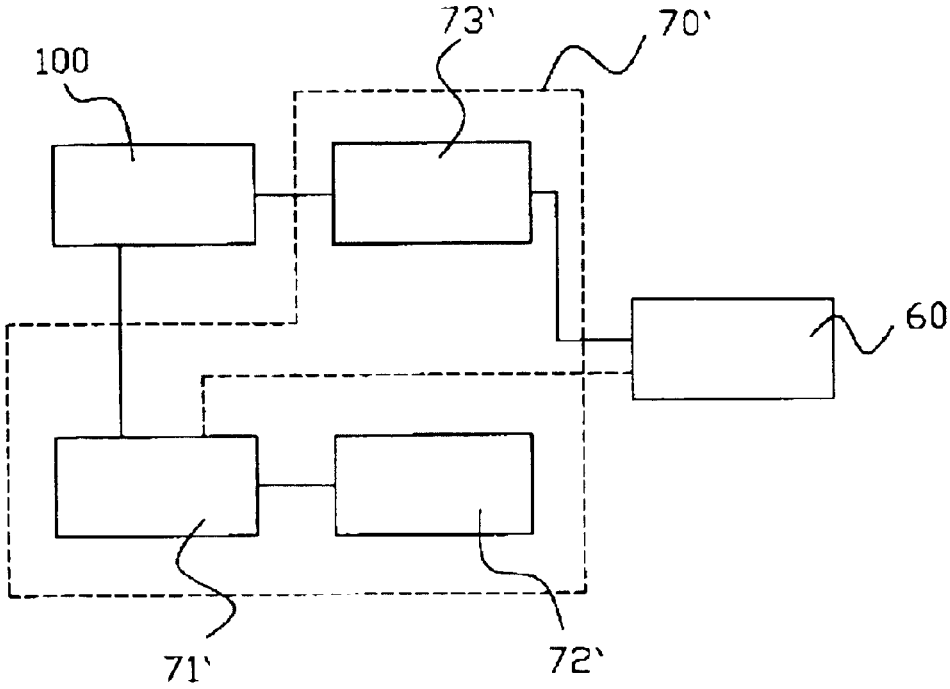
FIG. 17 is a block diagram showing a freshness maintaining apparatus, according to a ninth embodiment of the present invention, with the apparatus being provided with a dehumidifying unit.

Alternatively, a dehumidifying unit 70' may not be installed in the humidifying unit 50 but may be installed separately from the humidifying unit 50, as shown in FIG. 17. The dehumidifying unit 70' includes an air cooling unit 71', a humidity sensor 73', and a feed fan 72'. The air cooling unit 71' operated by a thermoelectric semiconductor is installed to be positioned under a water storage unit 100. An outlet port of the air cooling unit 71' is connected to the water storage unit 100. The humidity sensor 73' connected to the control unit 60 is mounted to a position of the water storage unit 100, that is, to a position above a water level of the water storage unit 100. The feed fan 72' is mounted to an inlet port of the air cooling unit 71'. The operation of the dehumidifying unit 70' constructed in this way is as follows. That is, air fed to the dehumidifying unit 70' by the feed fan 72' is cooled, dehumidified, and dried by the thermoelectric semiconductor. Subsequently, the cooled, dehumidified, and dried air is fed to the water storage unit 100 through the outlet port of the air cooling unit 71'.

When it is determined that a humidity level exceeds a predetermined value by the humidity sensor 73' connected to the control unit 60, the humidifying unit 50 is turned off by an operation of a relay. That is, in response to a signal output from the humidity sensor 73', the dehumidifying unit 70' or the humidifying unit 50 is selectively operated.

Further, an air inlet port may be provided at a predetermined position of the water storage unit 100 to be connected to the air cooling unit 71'. After air is cooled by the humidifying unit, the air flows to the air cooling unit 71' to be further cooled. The cooled air is fed back to the water storage unit 100 through the outlet port of the air cooling unit 71'.

Figure 6:
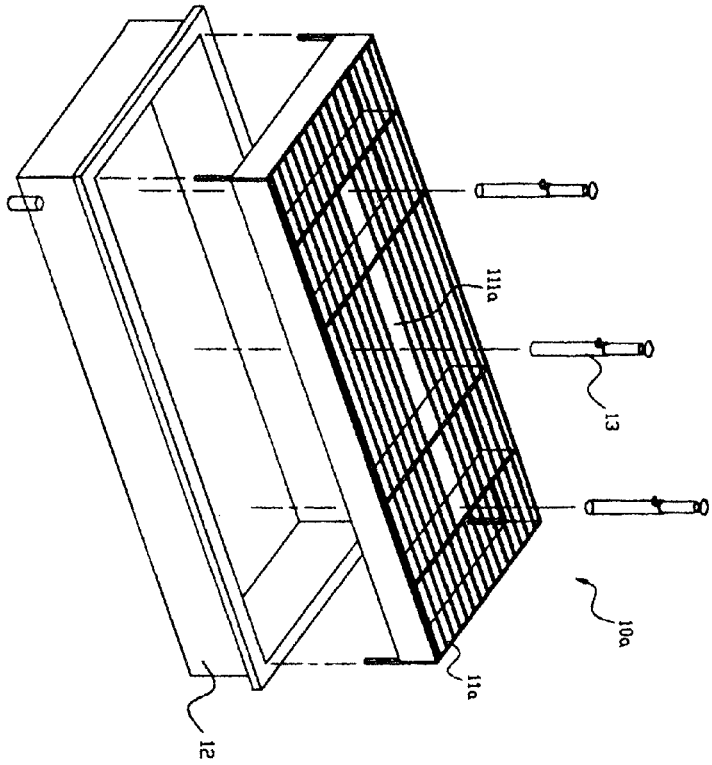
FIG. 6 is a perspective view showing a water storage unit included in a freshness maintaining apparatus, according to a second embodiment of the present invention.

FIG. 6 is a perspective view showing a water storage unit included in a freshness maintaining apparatus, according to a second embodiment of the present invention. When one desires to display or store items, such as vegetables and bean-curd, using the apparatus according to the second embodiment of the present invention, a net-shaped support unit 11*a* is mounted to the body 12 of the water storage unit 10 so that the items are placed on the support unit 11*a*. A plurality of through holes 111*a* are formed in the support unit 11*a* so that the humidifying pipes 13 pass through the support unit 11*a*. Thus, lower portions of the items are affected by the cool water stored in the water storage unit 10, through the net-shaped support unit 11*a*. On the other hand, the cool and humid air is transmitted to upper portions of the items by the humidifying pipes 13. Therefore, the items are displayed and stored under cool and humid condition.

Figure 7:
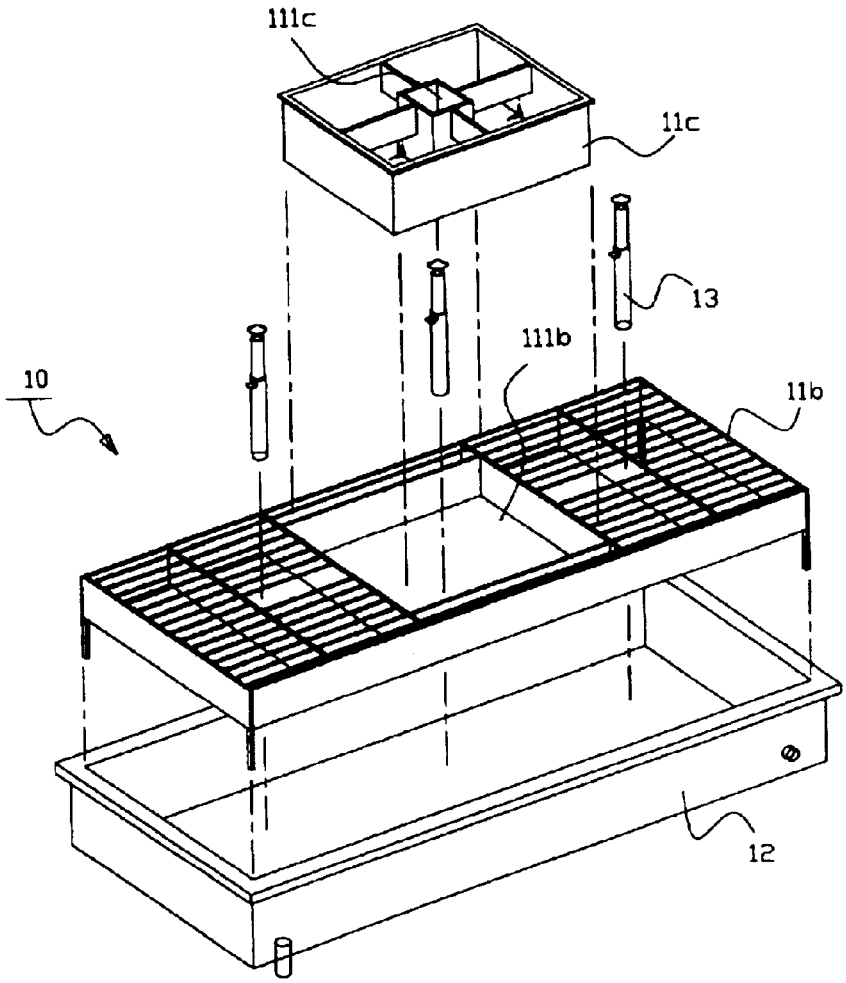
FIG. 7 is a perspective view showing a water storage unit included in a freshness maintaining apparatus, according to a third embodiment of the present invention.
Figure 8:
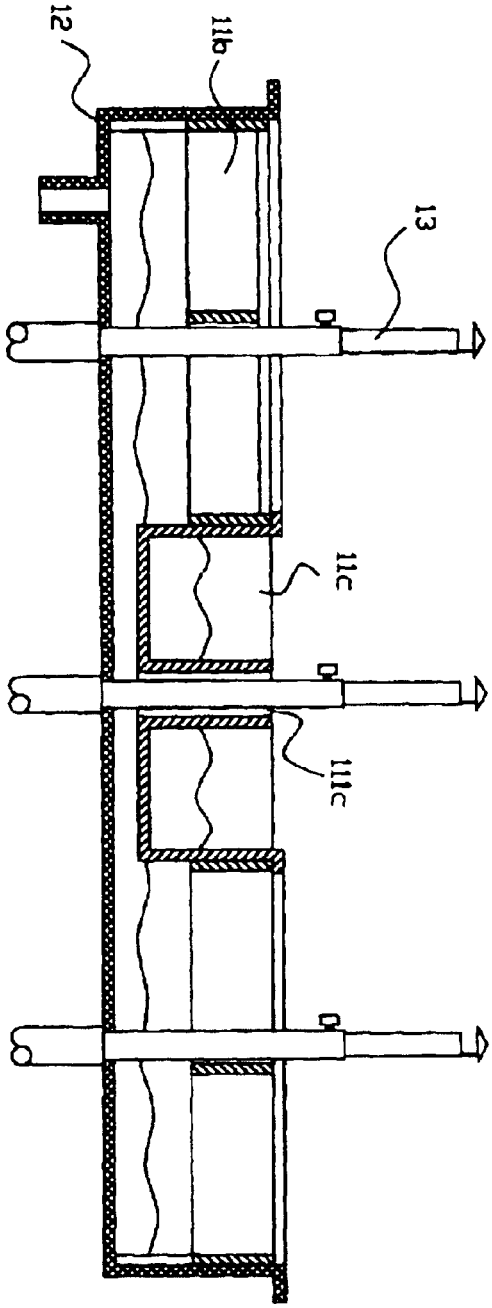
FIG. 8 is a sectional view showing an interior structure of the water storage unit shown in FIG. 7.

FIG. 7 is a perspective view showing a water storage unit included in a freshness maintaining apparatus, according to a third embodiment of the present invention. FIG. 8 is a sectional view showing an interior structure of the water storage unit shown in FIG. 7. When one desires to store two or more items using the apparatus of the present invention, the shape of the support unit which is mounted to the water storage unit 10 may be changed as shown in FIGS. 7 and 8. For example, when one desires to store flowers and vegetables, the stems of the flowers soak in water contained in the water storage unit 10. In this case, the water stored in the water storage unit 10 is used to produce cool and humid air. However, the water stored in the water storage unit 10 is poor in quality. Thus, an additional water container 11*c* may be provided to store the flowers. That is, as shown in FIGS. 7 and 8, a seating hole 111*b* is formed at a center of the support unit 11*b* which has the net shape so that the vegetables are placed thereon. The water container 11*c* is installed in the seating hole 111*b*. In this way, the water in which the stems of the flowers soak is separated from the water which is used to humidify the flowers and the vegetables. In a detailed description, a through hole 111*c* is formed at a center of the water container 11*c*. The humidifying pipe 13 passes through the through hole 111*c* so that an upper end of the humidifying pipe 13 is positioned above water contained in the water container 11*c*. In the water container 11*c* is contained the water in which the stems of the flowers soak. In the water storage container 10 is contained the water which is used to humidify the flowers and vegetables.

When the freshness maintaining apparatus is constructed as shown in FIGS. 7 and 8, the water of the water container 11*c* is cooled by the water of the water storage unit 10 which is cooled to the predetermined temperature by the cooling unit 40, thus the water in the water container 11*c* as well as the water in the water storage unit 10 is kept cool.

Figure 9:
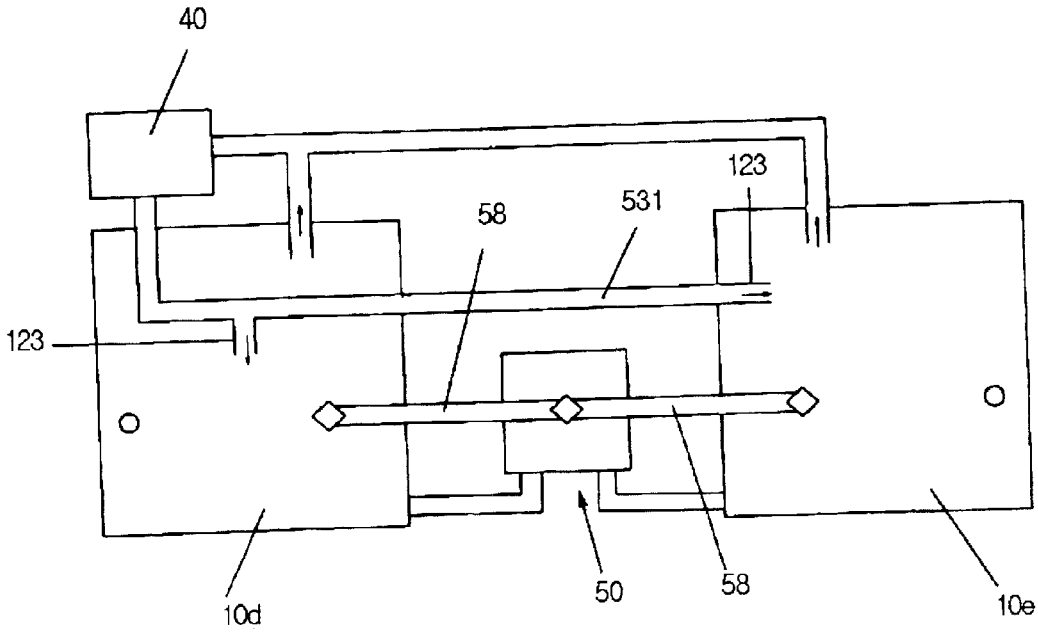
FIG. 9 is a sectional view showing a freshness maintaining apparatus, according to a fourth embodiment of the present invention.

FIG. 9 is a sectional view showing a freshness maintaining apparatus, according to a fourth embodiment of the present invention. As shown in FIG. 9, the apparatus may be provided with a plurality of water storage units which are connected to each other. FIG. 9 shows the apparatus provided with two water storage units. As shown in FIG. 9, the apparatus includes first and second water storage units 10*d* and 10*e*, each of which is provided with the support unit and contains water therein. Each of the first and second water storage units 10*d* and 10*e* is connected at a lower end thereof to a cooling unit 40 and a humidifying unit 50. A humidifying pipe 13 is mounted to each of the first and second water storage units 10*d* and 10*e* to be connected to a distributing pipe 58 of the humidifying unit 50. Further, a connection hole 123 is provided at a predetermined position of each of the first and second water storage units 10*d* and 10*e* to be connected to a cool water supply pipe 531.

The operation of the apparatus constructed in this way is as follows. First, water is supplied to the first and second water storage units 10*d* and 10*e*, and items taken out from a refrigerator and others are aesthetically placed on the net-shaped support unit. The water is fed from the first and second water storage units 10*d* and 10*e* to the cooling unit 40 to be cooled. Next, the cool water is fed back to the first and second water storage units 10*d* and 10*e* through the connection hole 123 connected to the cool water supply pipe 531. The water fed to the first and second water storage units 10*d* and 10*e* is automatically mixed, thus the water contained in the water storage units 10*d* and 10*e* maintains the predetermined temperature.

Further, the humidifying unit 50 functions to atomize the water fed from the first and second water storage units 10*d* and 10*e*, prior to spraying humid air through the distributing pipe 58 and the humidifying pipe 13 to the first and second water storage units 10*d* and 10*e*.

Such a spraying operation may accomplish a collateral effect of decoration. That is, the water storage unit may be installed in a decorative article, such as a flower carriage, such that the water storage unit is not exposed to the outside. Further, the water storage unit may have a shape of pottery.

Meanwhile, when one desires to store fruit, such as peaches, the shape of the water storage unit may be varied to have a sealed structure. The net-shaped support unit is mounted to the water storage unit having the sealed structure, and water is supplied to the water storage unit to be contained under the support unit.

Further, when one desires to export vegetables, fruit, and others using the apparatus of the present invention, the shape of the body of the water storage unit may be designed to have the shape of a ship container. The net-shaped support unit is mounted to the water storage unit having the shape of the ship container, and water is supplied to the water storage unit to be contained under the support unit.

That is, the water storage unit may be varied according to the kinds of items stored therein.

Further, when the water storage unit having the sealed construction or the shape of the container is used, the cooling unit and the humidifying unit connected to the water storage unit may execute a cooling operation using a heat exchanger and a mechanical humidifying operation using an air compressor as necessary, in addition to the operation according to the present invention.

In the operation of the apparatus of the present invention, the amount of water vapor in the humid air caused by the atomized water generated by the apparatus exceeds saturation humidity that is required to saturate the air. However, since cool water having a low temperature is atomized into the air to produce the humid air by the humidifying unit 50 of the apparatus, the saturation humidity at the low temperature of the atomized water is lower than that at an external temperature, that is, a temperature of a space around the stored items. When the water is atomized into the air by the humidifying unit 50 to produce the humid air and the humid air of which the amount of water vapor exceeds the saturation humidity at the low temperature is in contact with the stored items, the saturation humidity at the surfaces of the stored items is higher than that of the humid air since the temperature of surfaces of the stored items is higher than that of the humid air. Thus, although the humid air in contact with the surfaces of the stored items, level of the humidity of the humid air does not exceed relative humidity at the surfaces of the stored items, therefore the items are not moist with the humid air.

Further, as shown in FIGS. 11 to 15, a water storage unit, a humidifying unit, and a cooling unit may be integrated into a single structure, thus accomplishing a compact apparatus. Alternatively, as shown in FIG. 16, a large-sized apparatus may be accomplished. The construction will be described in the following with reference to the drawings.

Figure 11:
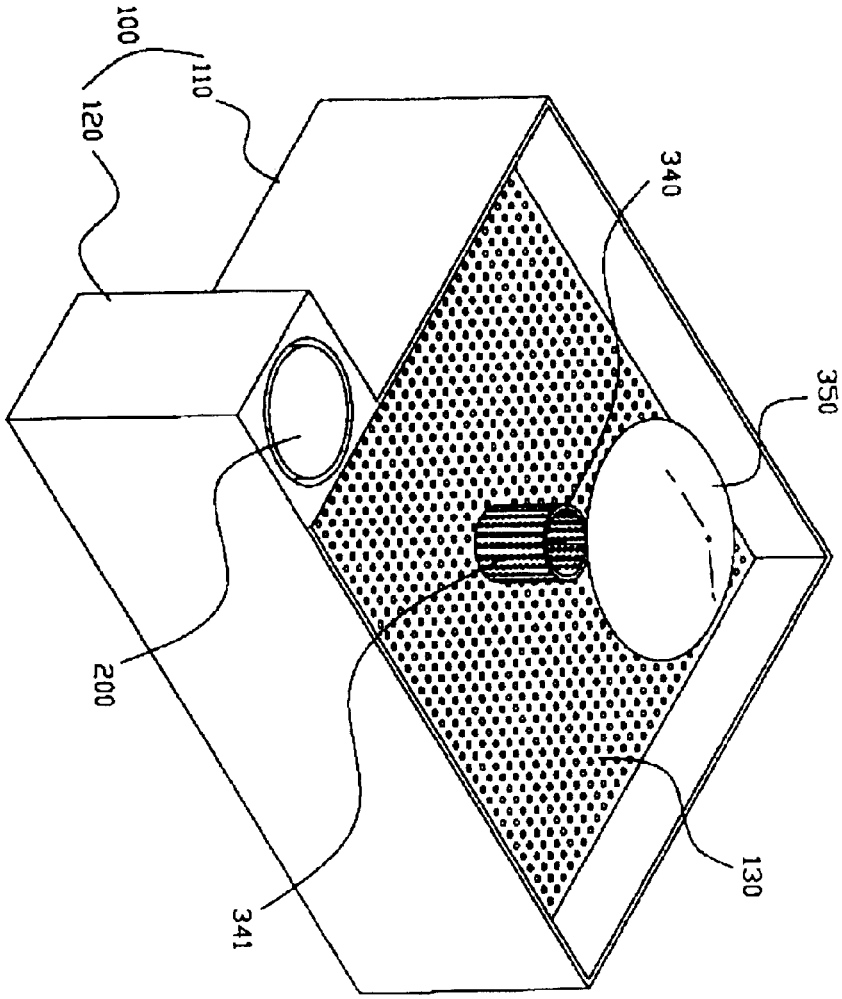
FIG. 11 is a perspective view showing a freshness maintaining apparatus, according to a sixth embodiment of the present invention.
Figure 12:
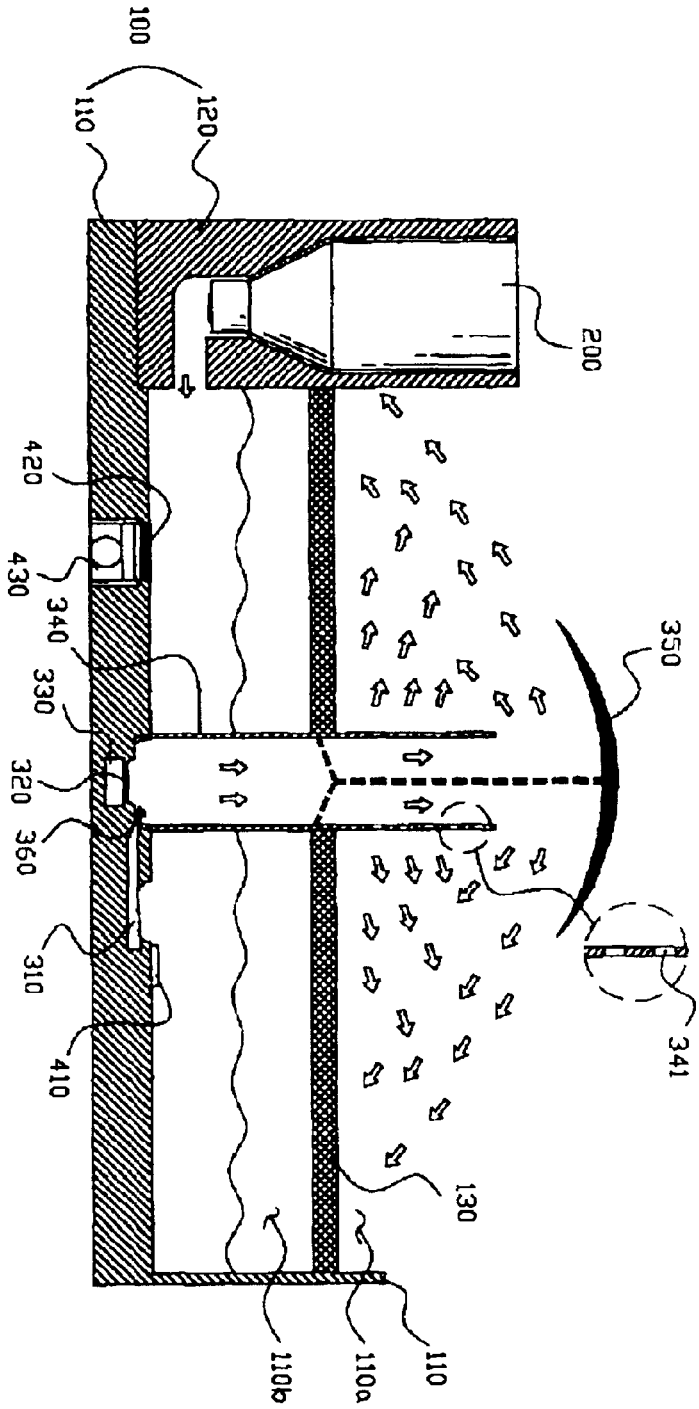
FIG. 12 is a sectional view showing an interior structure of the apparatus of FIG. 11.
Figure 13:
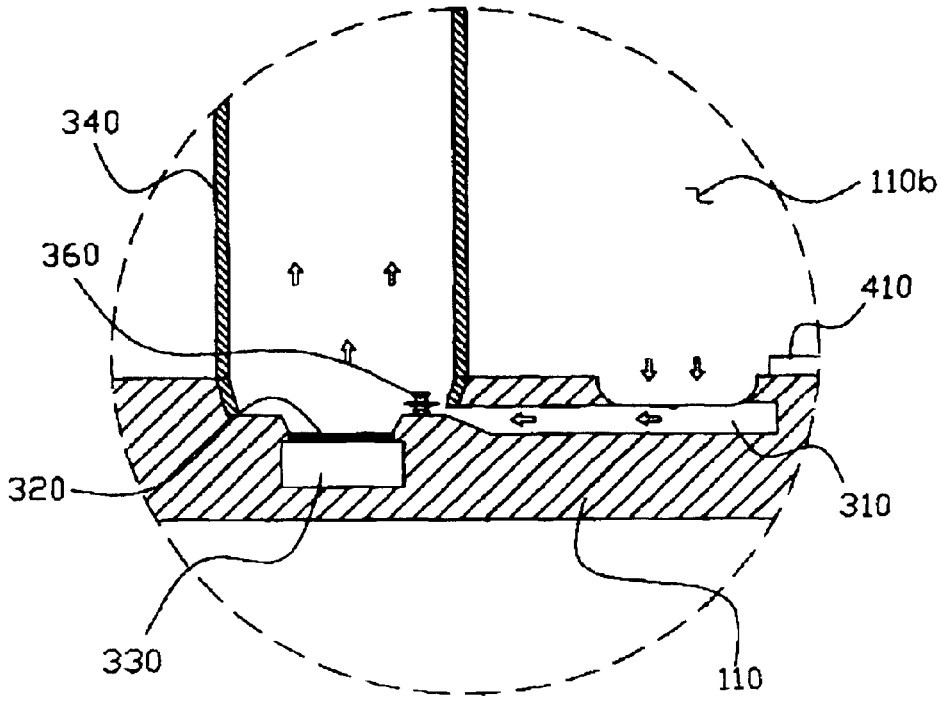
FIG. 13 is an enlarged view showing a humidifying unit included in the apparatus of FIG. 11.
Figure 14:
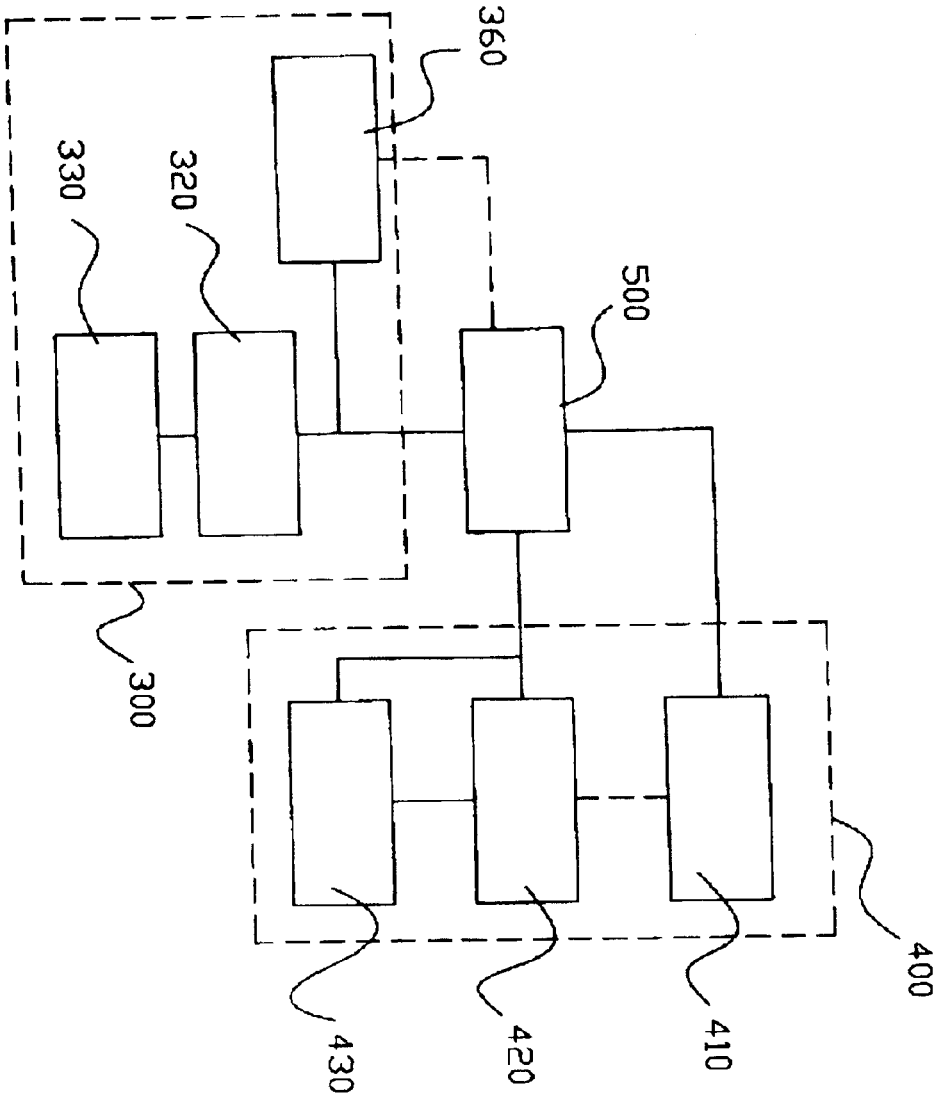
FIG. 14 is a block diagram showing the connection structure of several units included in the apparatus of FIG. 11.

FIG. 11 is a perspective view showing a freshness maintaining apparatus, according to a sixth embodiment of the present invention, FIG. 12 is a sectional view showing an interior structure of the apparatus, according to the sixth embodiment of the present invention, FIG. 13 is an enlarged view showing a humidifying unit included in the apparatus, according to the sixth embodiment of the present invention, and FIG. 14 is a block diagram showing the connection structure of several units included in the apparatus, according to the sixth embodiment of the present invention. As shown in FIG. 11, water is continuously fed to a water storage unit 100 by a water feed unit 200. Items, such as flowers, are supported by a support unit 130 which is installed in the water storage unit 100. The water contained in a body 110 of the water storage unit 100 is atomized by a humidifying unit 300 which is integrally mounted to a lower portion of the body 110. A cooling unit 400 is integrally mounted to the lower portion of the body 110 between the humidifying unit 300 and the water feed unit 200.

The water storage unit 100 includes the body 110 to which the support unit 130 is mounted. A mounting part 120 is integrally provided at a predetermined position of the body 110 so that the water feed unit 200 is mounted in the mounting part 120. The body 110 is divided into an upper portion 110*a* and a lower portion 110*b* by the support unit 130. The mounting part 120 is designed to communicate with the lower portion 110*b* of the body 110. That is, water is fed to the lower portion 110*b* of the body 110 along the water feed unit 200 which is installed in the mounting part 120, and the items are supported by the support unit 130 in the upper portion 110*a* of the body 110.

Further, the humidifying unit 300 is installed at a center of the body 110 in such a way as to be projected to the upper portion 110*a* of the body 110. The cooling unit 400 is mounted to a bottom of the body 110 between the humidifying unit 300 and the mounting part 120.

The humidifying unit 300 functions to atomize the water contained in the lower portion 110*b* of the body 110 by a vibrator 320, and to feed the water to the upper portion 110*a* of the body 110. As shown in FIG. 13, the humidifying unit 300 includes a coupling pipe 310 through which the water is fed from the body 110 to the humidifying unit 300. The vibrator 320 functions to convert the water fed from the coupling pipe 310 into vapor, by a vibration. A high-frequency microwave generator 330 is mounted to a lower portion of the vibrator 320 to actuate the vibrator 320. A humidifying pipe 340 uprightly stands on a bottom of the body 110 in such a way that the vibrator 320 is positioned at a lower end of the humidifying pipe 340. A spraying part 350 is mounted to an upper end of the humidifying pipe 340. A water level sensor 360 is mounted to the lower end of the humidifying pipe 340 to be positioned at a predetermined position of the vibrator 320.

The humidifying pipe 340 functions to feed water vapor generated by the vibrator 320 and the high-frequency microwave generator 330 to the upper portion 110*a* of the body 110, and is mounted to the water storage unit 100 in such a way as to vertically pass through the support unit 130. A plurality of spray holes 341 are formed in an upper portion of the humidifying pipe 340 which is positioned above the support unit 130. Further, the humidifying pipe 340 is opened at a portion thereof so that water is fed from the coupling pipe 310 to the humidifying pipe 340.

The operation of the humidifying unit 300 constructed in this way is as follows. First, the water flows from the lower portion 110*a* of the body 110 to the coupling pipe 310. The water of the coupling pipe 310 flows to the humidifying pipe 340 to which the vibrator 320 is mounted. Next, the vibrator 320 is vibrated by the high-frequency microwave generator 330 to atomize the water, and then the atomized water is fed to the upper portion 110*a* of the body 110 through the humidifying pipe 340. At this time, the atomized water is downwardly sprayed by the umbrella-shaped spraying part 350 which is mounted to the upper end of the humidifying pipe 340. Further, the atomized water is upwardly sprayed by a plurality of spry holes 341 which are formed in the humidifying pipe 340. That is, the humid air atomized by the vibrator 320 are upwardly and downwardly sprayed by the spraying part as 350 well as the spray holes 341.

Further, a filtering unit may be mounted to a predetermined position of the body 110 of the water storage unit 100 in such a way as to be connected to the humidifying unit 300. The filtering unit functions to remove impurities from the water flowing to the humidifying unit 300.

The cooling unit 400 functions to cool the water contained in the lower portion 110*b* of the body 110 to the temperature of 2~6° C. The cooling unit 400 includes a water temperature sensor 410, a thermoelement 420, and a heat sink or radiation fan 430. The water temperature sensor 410 is mounted to the lower portion 110*b* of the body 110. The thermoelement 420 is integrally mounted to the lower portion 110*b* of the body 110. The heat sink or radiation fan 430 is installed under the thermoelement 420. The temperature of the water contained in the lower portion 110*b* of the body 110 is sensed by the water temperature sensor 410. In the case where the water temperature exceeds 6° C., an electric current is supplied to the thermoelement 420. At this time, the thermoelement 420 absorbs heat from the water contained in the lower portion 110*b* of the body 110, thus cooling the water to 2~6° C. In this case, the heat generated by the thermoelement 420 is dissipated by the heat sink or radiation fan 430 which is installed under the thermoelement 420.

FIG. 14 a block diagram showing the connection structure of several units included in the apparatus, according to the sixth embodiment of the present invention. When one desires to store items, such as flowers, which must be maintained under a cool and humid condition and are difficult to maintain freshness when coming into contact with water, the flowers are put into the water storage unit 100 to be supported by the support unit 130. At this time, lower portions of stems of the flowers come into contact with the water contained in the lower portion 111*a* of the body 110. The water is fed to the lower portion 110*b* of the body 110 through the water feed unit 200 which is installed in the mounting part 120. Alternatively, the water may be directly fed to the body 110 and the water feed unit 200 may serve as a subsidiary means for feeding water to the body 110.

As such, when the flowers are put into the water storage unit 100 and then the apparatus is operated in response to a signal output from the control unit 60, the temperature of the water contained in the body 110 is sensed by the water temperature sensor 410. In this case, when the water temperature exceeds 6° C., the thermoelement 420 of the cooling unit 400 is operated to cool the water contained in the body 110 to 2~6° C. When the water maintains temperature of 2~6° C. by the operation of the cooling unit 400, the vibrator 320 is operated by the high-frequency microwave generator 330 of the humidifying unit 300 to atomize the water, prior to feeding the atomized water to the humidifying pipe 340. Thereafter, the atomized water is upwardly and downwardly sprayed on the flowers stored in the body 110 by the spray holes 341 and the spraying part 350. Further, the water level sensor 360 is installed at a predetermined position of the humidifying unit 300. The high-frequency microwave generator 330 and the vibrator 320 are operated in response to a signal output from the water level sensor 360.

As such, since the cool and humid air of 2~6° C. are upwardly and downwardly sprayed on the flowers stored in the body 110, the flowers have prolonged freshness for a lengthy period of time.

Figure 15:
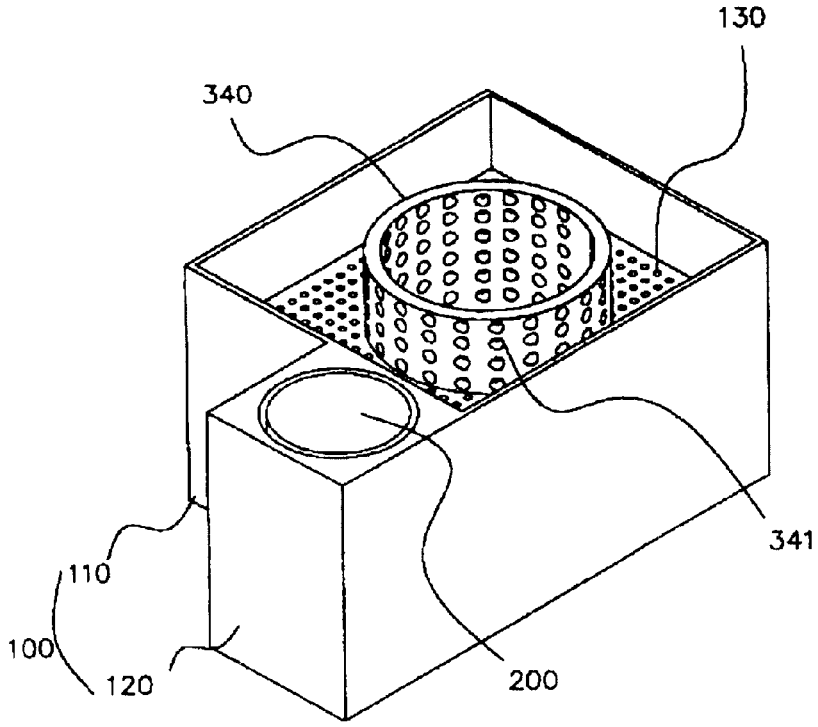
FIG. 15 is a perspective view showing a freshness maintaining apparatus, according to a seventh embodiment of the present invention.
Figure 16:
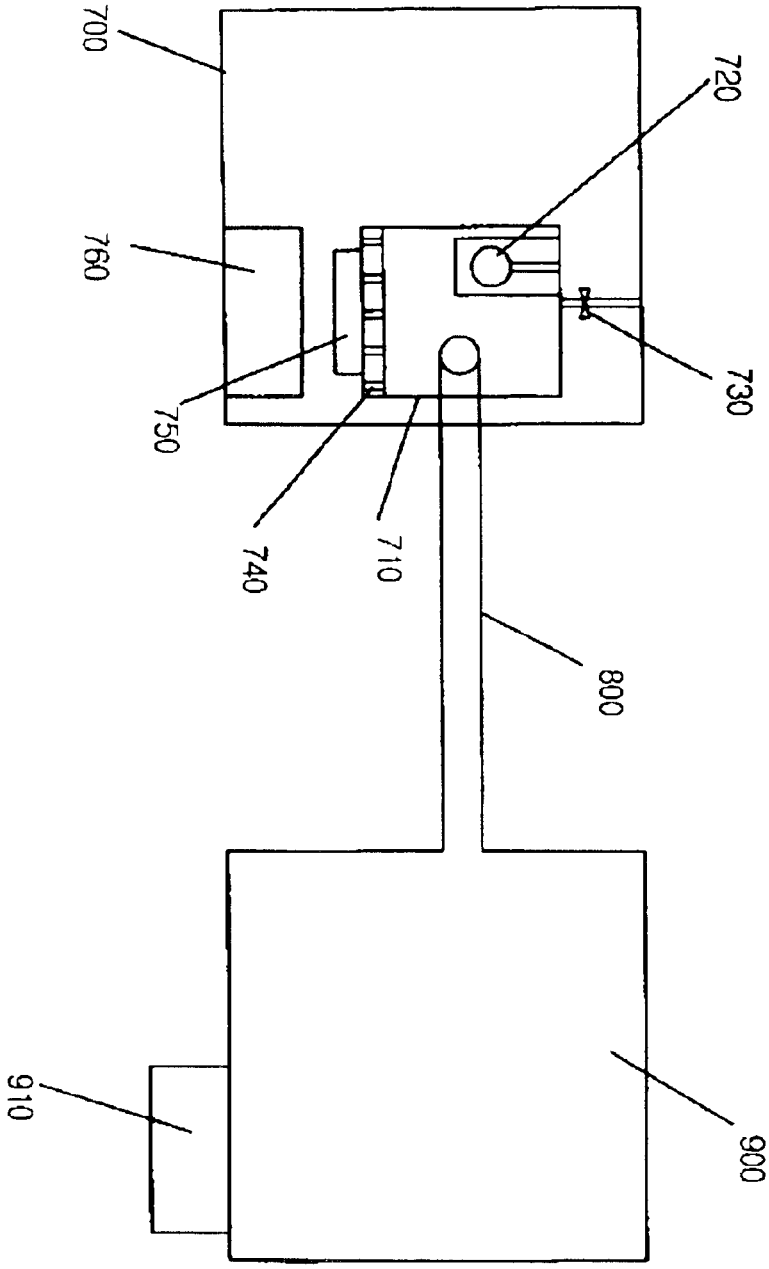
FIG. 16 is a view showing a freshness maintaining apparatus, according to an eighth embodiment of the present invention.

FIG. 15 is a perspective view showing a freshness maintaining apparatus, according to a seventh embodiment of the present invention. According to the seventh embodiment of the present invention, the apparatus is designed such that a body 110 has a small size, a humidifying pipe 340 has a large size but is not provided with a spraying part. In this case, items are not stored in a support unit but are directly put into and stored in the humidifying pipe 340 from which the spraying part is removed. That is, according to the seventh embodiment of the present invention, the humidifying pipe 340 has a shape of a vase, thus allowing the apparatus to have a smaller size.

FIG. 16 shows a freshness maintaining apparatus, according to an eighth embodiment of the present invention. According to the eighth embodiment of the present invention, the apparatus has a structure to generate a large amount of humid air. That is, the apparatus includes a humidifying unit 700. The humidifying unit 700 has a humidifying tank 710. A water supply port 730 is provided at an upper portion of the humidifying unit 700, and is opened and closed by a water level control unit 720. A humidifying part 740, a first cooling part 750, and a radiating part 760 are provided at a lower portion of the humidifying unit 700. In this case, the humidifying part 740 functions to vaporize water contained in the humidifying tank 710 by a vibrator. The first cooling part 750 functions to cool the water contained in the humidifying tank 710. The radiating part 760 functions to radiate heat of the first cooling part 750 to an outside. In a detailed description, an amount of the water contained in the humidifying tank 710 is detected by the water level control unit 720. In response to a signal output from the water level control unit 720, the water supply port 730 is opened or closed to feed water to the humidifying tank 710. The water fed to the humidifying tank 710 is cooled to a temperature of 2~6° C. by the first cooling part 750. Further, air humidified by the humidifying part 740 is fed through a hose 800 to a main tank 900 in which items are stored. A second cooling part 910 is mounted to a predetermined position of the main tank 900 to cool the water contained in the main tank 900. That is, atomized humid air is continuously fed to the items stored in the main tank 900 by the humidifying unit 700 separated from the main tank 900, regardless of an amount of the water contained in the main tank 900, thus allowing the humidifying unit as well as the main tank to have a large size.

As described above, the present invention provides a freshness maintaining apparatus, which is designed to feed cool and humid air of 2~6° C. to items stored in a water storage unit, thus being used for storing flowers as well as foodstuffs which are kept fresh, such as vegetables, beancurd, fruit, and others.

Particularly, in case of storing flowers using the apparatus of the present invention, cool water of 2~6° C. is supplied to stems of the flowers which soak in a water storage unit and humid air is continuously supplied to other parts of the flowers which are above the surface of the water of the water storage unit, by a humidifying pipe, thus allowing the flowers to be kept fresh for a lengthy period of time.

The present invention provides a freshness maintaining apparatus, which is designed such that atomized humid air is downwardly spread, thus being easy to increase the humidity of a large space, and which is designed such that a plurality of water storage units are connected to each other, thus allowing a large amount of items to be freshly stored.

Further, the present invention provides a freshness maintaining apparatus, which is operated in a humidifying mode, thus preventing moisture from being produced on the surfaces of items even when the items stored in the apparatus come into contact with humid air, therefore allowing the items to be freshly stored and displayed while maintaining freshness thereof for a lengthy period of time.

The present invention provides a freshness maintaining apparatus, which is designed such that a humidifying unit is separated from a cooling unit, thus allowing a water storage unit to be varied in shape as necessary. Particularly, when a lamp is installed in the water storage unit, the freshness maintaining apparatus provides an elegant illumination effect.

Further, when the freshness maintaining apparatus is used to store items which are difficult to keep fresh, such as peaches, cool and humid air is continuously fed to the items upwards and downwards, thus allowing the items to be kept fresh for a lengthy period of time. That is, when the water storage unit of the present invention is used to store fruit, the fruit is kept fresh for a lengthy period of time.

The freshness maintaining apparatus of the present invention is further provided with a dehumidifying unit, thus allowing cool and humid air or cool and dried air to be selectively fed to items, therefore storing the items under an optimum condition and thereby allowing the items to be effectively stored for a lengthy period of time.

Further, the present invention provides a freshness maintaining apparatus, which is designed to have a small size, thus being easy to carry, and which is designed such that water is atomized by a vibration of a vibrator operated by a high-frequency microwave generator, thus reducing a noise.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for maintaining freshness, comprising:

a water storage unit, with a support unit being installed in the water storage unit and cooling water being contained in the water storage unit under the support unit;

a filtering unit connected to the water storage unit via a drain line, and functioning to remove impurities from water flowing to the filtering unit;

a cooling unit connected to a first end of a water supply branching pipe of the filtering unit so that a part of filtered water is supplied to the cooling unit, the cooling unit functioning to cool the filtered water fed from the filtering unit to a predetermined temperature prior to feeding the cool water to the water storage unit; and a humidifying unit connected to a second end of the water supply branching pipe of the filtering unit, the humidifying unit functioning to atomize another part of the filtered water fed from the filtering unit prior to feeding the atomized water to the water storage unit.

2. The apparatus according to claim 1, wherein said water storage unit comprises:

a body containing water therein, with a drain hole being provided at a predetermined position of a bottom of the body to be connected to the drain line and a connection hole being provided at a predetermined position of the body to be connected to the cooling unit;

the support unit integrally installed on the body to be parallel to the bottom of the body, the support unit functioning to support an item stored in the body; and a plurality of humidifying pipes mounted to the body in such a way as to uprightly stand on the bottom of the body, each of the humidifying pipes vertically passing through the support unit such that an upper end of each of the humidifying pipes is positioned above the support unit.

3. The apparatus according to claim 2, wherein each of the humidifying pipes of the water storage unit comprises:

a lower pipe installed on the bottom of the water storage unit to be connected to the humidifying unit;

an upper pipe inserted into the lower pipe;

a locking member installed at a predetermined position of an upper portion of the lower pipe to lock the upper pipe to the lower pipe; and a spraying part installed at an upper end of the upper pipe.

4. The apparatus according to claim 2, wherein a seating hole is formed at a center of the support unit of the water storage unit, and a water container is installed in the seating hole.

5. The apparatus according to claim 1, wherein said drain line comprises:

a first drain pipe connected to the water storage unit;

an automatic valve connected to an end of the first drain pipe;

a second drain pipe connected at a first end thereof to the automatic valve and at a second end thereof to the filtering unit;

a water supply pump installed at a predetermined position of the second drain pipe; and a third drain pipe connected to the automatic valve to discharge water to an outside of the apparatus.

6. The apparatus according to claim 1, wherein said cooling unit comprises:

a housing, including:

a water inlet port connected to the first end of the water supply branching pipe of the filtering unit;

a cooling part to cool the water supplied through the water inlet port to the predetermined temperature by a heat exchanger which is installed on a bottom of the cooling part, with a water temperature sensor being installed in the cooling part; and a water feed unit communicating with the cooling part, and functioning to feed the cool water from the cooling unit to the water storage unit through a cool water supply pipe; and a feed pump mounted on a top wall of the housing to be connected to the water feed unit.

7. The apparatus according to claim 1, wherein said humidifying unit comprises:

a body provided in a housing and connected to the second end of the water supply branching pipe of the filtering unit so that the filtered water from the filtering unit is fed into and stored in the body, with a water level sensor being installed in the body;

an automatic shutoff valve installed between the body and the housing, and actuated in response to a signal output from the water level sensor;

a vibrator mounted to a predetermined position on a bottom of the housing, and functioning to convert water fed from the body into vapor by vibration;

a high-frequency wave generator mounted to a bottom of the vibrator to actuate the vibrator;

a humid air supply channel upwardly and uprightly extending from the bottom of the housing in such a way that the vibrator is positioned at a lower end of the channel;

a coupling pipe to couple the body to the humid air supply channel;

a blower communicating with the humid air supply channel; and a distributing pipe connected at an end thereof to the housing and at predetermined portions thereof to a plurality of humidifying pipes of the water storage unit.

8. The apparatus according to claim 7, further comprising a water level regulating pipe is provided at a predetermined position in the humid air supply channel of the humidifying unit.

9. The apparatus according to claim 7, further comprising a dehumidifying unit provided in the humidifying unit, and functioning to dehumidify air flowing thereinto by the blower, prior to discharging dehumidified air to the humid air supply channel.

10. The apparatus according to claim 1 or 7, wherein a plurality of water storage units are connected to each other.

11. The apparatus according to claim 1 or 7, further comprising a cover made of a transparent material and mounted to an upper portion of the water storage unit.

12. The apparatus according to claim 1, wherein said water storage unit, the cooling unit, and the humidifying unit are integrated into a single structure.

13. The apparatus according to claim 1, further comprising a dehumidifying unit, in addition to the water storage unit, the cooling unit, the filtering unit, and the humidifying unit.

14. The apparatus according to any one of claims 1, 2, 6, 12 and 13, wherein said cooling unit cools the water contained in the water storage unit to 2° C.~6° C.

* * * * *